US012055002B2

(12) United States Patent
van Petegem

(10) Patent No.: US 12,055,002 B2
(45) **Date of Patent: *Aug. 6, 2024**

(54) ROLL-OUT APPARATUS, METHOD, AND SYSTEM

(71) Applicant: Ronald van Petegem, Montgomery, TX (US)

(72) Inventor: Ronald van Petegem, Montgomery, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/848,996

(22) Filed: Jun. 24, 2022

(65) Prior Publication Data

US 2022/0316291 A1 Oct. 6, 2022

Related U.S. Application Data

(63) Continuation of application No. 17/207,528, filed on Mar. 19, 2021, now Pat. No. 11,401,762.

(60) Provisional application No. 63/110,989, filed on Nov. 7, 2020, provisional application No. 62/994,005, filed on Mar. 24, 2020.

(51) Int. Cl.

| | |
|---|---|
| ***E21B 23/06*** | (2006.01) |
| ***E21B 33/12*** | (2006.01) |
| ***E21B 33/128*** | (2006.01) |

(52) U.S. Cl.

CPC ..... *E21B 23/06* (2013.01); *E21B 33/1216* (2013.01); *E21B 33/128* (2013.01); *E21B 2200/08* (2020.05)

(58) Field of Classification Search

CPC ..... E21B 23/10; E21B 23/06

See application file for complete search history.

(56) References Cited

U.S. PATENT DOCUMENTS

| | | | | |
|---|---|---|---|---|
| 4,333,661 | A | 6/1982 | Merrell | |
| 4,745,972 | A * | 5/1988 | Bell | E21B 33/1216 166/134 |
| 6,793,022 | B2 * | 9/2004 | Vick | E21B 33/129 166/387 |
| 8,579,024 | B2 | 11/2013 | Malland et al. | |
| 10,119,359 | B2 | 11/2018 | Frazier | |

(Continued)

FOREIGN PATENT DOCUMENTS

| | | |
|---|---|---|
| GB | 2253870 A | 9/1992 |
| WO | WO2012045168 | 4/2012 |

OTHER PUBLICATIONS

PCT International Search Report for PCT/US2021/023757.

(Continued)

*Primary Examiner* — Christopher J Sebesta
(74) *Attorney, Agent, or Firm* — Matthew Compton

(57) ABSTRACT

A roll-out apparatus, method, and system is disclosed for deployment in a subterranean well at a setting location. The roll-out apparatus, method, and system includes a load ring and an energizing ring. The load ring may include an outer surface having an outer circumference and a slot extending through the entire wall thickness that follows a circuitous path from a front face to a back face of the load ring. The energizing ring includes an outer surface configured to contact an inner surface of the load ring to enlarge the outer circumference of the load ring in a radial direction. This causes the outer surface of the load ring to seal to an inner surface of the subterranean well at the setting location.

33 Claims, 12 Drawing Sheets

(56) References Cited

U.S. PATENT DOCUMENTS

| | | | | |
|---|---|---|---|---|
| 2009/0126925 | A1 | 5/2009 | Guest | |
| 2014/0196889 | A1 | 7/2014 | Oberg | |
| 2015/0285026 | A1 | 10/2015 | Frazier | |
| 2017/0022781 | A1 | 1/2017 | Martin et al. | |
| 2018/0016864 | A1 | 1/2018 | Parekh | |
| 2018/0038193 | A1* | 2/2018 | Walton | E21B 23/06 |
| 2018/0266205 | A1 | 9/2018 | Martin et al. | |
| 2019/0368304 | A1* | 12/2019 | Deng | E21B 33/1216 |
| 2019/0383108 | A1* | 12/2019 | Massey | E21B 17/1057 |
| 2020/0063521 | A1* | 2/2020 | Godfrey | E21B 33/1293 |

OTHER PUBLICATIONS

Written Opinion of the International Searching Authority for PCT/US2021/023757.
Office Action in co-pending U.S. Appl. No. 17/849,046.

* cited by examiner

ROLL-OUT APPARATUS, METHOD, AND SYSTEM

CROSS REFERENCE TO RELATED APPLICATIONS

This patent application claims priority to U.S. patent application Ser. No. 17/207,528, filed Mar. 19, 2021, which claims priority to U.S. Provisional App. No. 62/994,005 filed 2020 Mar. 24 and to U.S. Provisional App. No. 63/110,989 filed 2020 Nov. 7, all of which are hereby incorporated herein by reference.

FIELD OF INVENTION

The invention relates to what is generally known as a completion, workover, stimulation, or intervention of subterranean wells. Specifically, this invention relates to flow control devices, plugs and packers, and installing/removing flow control devices, plugs and packers from a subterranean wellbore.

BACKGROUND

Packers, plugs, and flow control devices such as landing nipples are used to support well stimulation, well completion, well workover, and well intervention operations. In many horizontal or near horizontal downhole applications (e.g., shale fracking) a plug or other device must be placed in the horizontal wellbore section. In these exemplary applications, a plug performs two actions: (1) grip, and (2) seal. One way of performing these actions is with a system using slips and elastomers that are pushed towards the wellbore using a cone and compression system. These systems may not be reliable or are limited because of the possibility of the elastomers extruding during use and losing their ability to seal or even swabbing off the device during the installation.

Another way of performing one or both of these actions is stretching a solid metal tube with a cone or other device. In this context, stretching means the expanding of a solid tube (i.e., a tube that is not slotted) such that both the outer perimeter and inner perimeter of the solid tube are enlarged. These systems may not be reliable or are limited because a solid metal tube can only be stretched a certain amount before it no longer has the mechanical integrity to perform its function. This technology is generally known to the industry as solid expandable.

Accordingly, there is a need for an apparatus that seals and/or grips against the wellbore wall without requiring any materials to be stretched or losing its ability to seal.

BRIEF DESCRIPTION

Embodiments of the invention allow for an apparatus, referred to as a roll-out apparatus, to be installed into a well tubular or open hole at a setting location. In one embodiment the roll-out apparatus includes a load ring that is rolled-out via an energizing ring. In the rolled-out position, the load ring may grip, seal, or both grip and seal to an inner surface of a well tubular or open hole creating a ledge in the wellbore. The ledge created by the roll-out apparatus may be used as seat for a ball or dart to create a diversion device, or to be used as a ledge to support the installation of downhole tools such as a pressure gauge.

Embodiments of the roll-out apparatus include a load ring having a generally tubular shape with at least one slot extending from the front face of the ring to the back face of the ring. The slot enables the load ring to roll-out or enlarge by bending, when energized on an inner surface of the load ring. The slot in the load ring follows a circuitous path and includes a first inner surface and a second inner surface that are configured to contact one another when the load ring is energized or enlarged. The load ring is further configured to contact an inner surface of the subterranean well at the setting location. This contact will result in a either a grip, a seal, or both a grip and seal. This interaction secures the roll-out apparatus in the subterranean well at the setting location.

To allow installation, the roll-out apparatus is typically run on a setting tool system, where the load ring and energizing ring is connected to the setting tool via a core, deployment device or system. The roll-out apparatus is first positioned on the deployment device. The system is then deployed into a wellbore and after the setting location is reached, the setting tool is activated causing the outer surface of the energizing ring to contact the inner surface of the load ring to enlarge the outer circumference of the load ring in a radial direction. This causes the load ring to contact an inside surface of the subterranean well at the setting location.

Those skilled in the art will appreciate that seal or sealing means that if a ball, dart, or plug is attached to the roll-out apparatus, and pressure is applied on top of the roll-out apparatus with the ball, plug, or dart, the leak rate is sufficiently low to allow fluids to be diverted into the formation above the roll-out apparatus. In other words, a 100% seal may be accomplished, but is not required to provide full functionality.

An advantage of the proposed method and apparatus is that it is a tubular ring that is enlarged by bending, to provide gripping and/or sealing to the inner surface of the subterranean well. The tubular ring includes a slot that enables the outer circumference of the load ring to enlarge in a radial direction thereby causing the outer surface of the load ring to contact an inner surface of the subterranean well at the setting location. The slot follows a circuitous path and includes a first inner surface and a second inner surface that are configured to contact one another when the load ring is energized or enlarged. Although the roll-out apparatus does not require additional parts to achieve its functionality, items such as a core, dart, plug, or ball may be incorporated with or after the installation, thereby interacting with the roll-out apparatus, creating additional functionality and possibly enhancing its grip and/or seal with the tubular wall. Thus, the roll-out apparatus may have profiles, shoulders or contours to interact with another device such as but not limited to: a ball, a dart, or a seal assembly.

The roll-out apparatus includes a load ring that may have a textured outer surface modified to enhance gripping and/or sealing to the wellbore walls. Such enhancements include, but are not limited to, particles such as silicon carbide (SiC) attached to the outer surface, which are harder than the material of the wellbore wall and/or the roll-out apparatus. Attachment of these particles may increase the friction force between the load ring and the subterranean well and can be accomplished using an epoxy or resin or other methods including, but not limited to: (1) sintering; (2) profiles machined or attached to the outer surface (the profiles may be treated to increase their hardness); and (3) sealing systems such as elastomers or thermo plastics bonded to the roll-out apparatus. The outer surface of the load ring may include at least one shoulder extending to or above the textured surface configured to engage the inner surface of the subterranean well. Those skilled in the art will appreciate that many different gripping and sealing systems or components exist and that these can be used on their own or in combination with each other. Even though the load ring's main purpose is to seal and grip, those skilled in the art will appreciate that the load ring may also be used for either gripping or sealing.

The roll-out apparatus and its other components can be made from a variety of materials, including but not limited to: alloy steel, stainless steel, duplex steel, elastomers, thermo plastics, composites, degradable materials, dissolvable material, aluminum, or combinations thereof. As discussed, another device or system such as a ball or dart can be installed to interact with the roll-out apparatus to collectively form a plug and/or to further enhance conformance of the roll-out with the inner circumference of the wellbore and/or enhance the gripping/sealing capabilities or other properties, performance, or features. These other devices or systems may be installed during, with, or after the installation of the roll-out apparatus. Some of these devices or systems can be used to enhance the ease of installation of the roll-out apparatus.

Other enhancements to the roll-out apparatus may include but are not limited to a load ring assembly that includes two or more rings interlocked together. Each ring includes a slot extending from the front face of the ring to the back face of the ring. The circuitous path of the load ring assembly is formed by orienting the slot of one ring at a different angular orientation to the adjacent ring so that the slots of each ring do not overlap when the load ring is enlarged by the energizing ring.

The specification provides one embodiment of an apparatus configured to be deployed in a subterranean well at a setting location having a load ring and an energizing ring. The load ring includes an outer surface having an outer circumference, an inner surface, a central axis, and a wall having a wall thickness. The wall includes at least one slot extending through the entire wall thickness, and the slot follows a circuitous path from a front face of the load ring to a back face of the load ring. The slot has a first inner surface and a second inner surface, and a portion of the first inner surface and a portion of the second inner surface are configured to contact one another when the outer circumference of the load ring is enlarged;

The energizing ring in this embodiment includes an outer surface, an inner surface, and a central axis. The outer surface of the energizing ring is configured to contact the inner surface of the load ring and to enlarge the outer circumference of the load ring in a radial direction. This causes the outer surface of the load ring to seal to an inner surface of the subterranean well at the setting location. Those skilled in the art will appreciate that in some cases and due to the high loads that the roll-out apparatus is subjected to, the apparatus may move or slip relative to the setting location. This movement or slipping is expected and normally not more than a few inches.

In this embodiment, the circuitous path of the slot may include a first portion that runs parallel to the central axis at the front face, a second portion that runs parallel to the central axis at the back face, and a third portion that runs perpendicular to the central axis at one or more locations between the front face and the back face. The circuitous path may also include at least one portion that is oriented at an angle to the central axis. In addition, the outer surface of the load ring may include a textured surface configured to engage and grip the inner surface of the subterranean well. The textured surface may also include a particulate configured to increase the friction force between the load ring and the subterranean well. In another embodiment, the outer surface of the load ring may include at least one shoulder extending to or above the textured surface to engage and grip the inner surface of the subterranean well.

In this embodiment, the inner surface of the load ring may include a convex surface relative to the central axis of the load ring, and the outer surface of the energizing ring may include a tapered surface relative to the central axis of the energizing ring. In another embodiment, the inner surface of the load ring may include a tapered surface relative to the central axis of the load ring, and the outer surface of the energizing ring may include a convex surface relative to the central axis of the energizing ring. In addition, the load ring, the energizing ring, or both the load ring and energizing ring may be made of a material that galvanically corrodes in a subterranean well. Similarly, the load ring, the energizing ring, or both the load ring and energizing ring may be made of a material that disintegrates or dissolves as a result of an interaction with a fluid in a subterranean well. The load ring, the energizing ring, or both the load ring and energizing ring may also include a composite material.

The load ring may be an assembly of two or more rings interlocked together. Each load ring may have a slot extending through the entire wall thickness from the front face of the ring to the back face of the ring. The circuitous path of the load ring may be formed by orienting the slot of at least one ring at a different angular orientation to the adjacent ring so that the slots of each ring do not overlap when the load ring is enlarged by the energizing ring.

According to another embodiment, the specification provides a method of installing an apparatus in a subterranean well. The method includes positioning a load ring and an energizing ring on a deployment device. The load ring includes an outer surface having an outer circumference, an inner surface, a central axis, and a wall having a wall thickness. The wall of the load ring includes at least one slot extending through the entire wall thickness, and the slot follows a circuitous path from the front face of the load ring to the back face of the load ring. The energizing ring includes an outer surface, an inner surface, and a central axis. The deployment device may include a pivot point configured to reduce the friction force between the deployment device and the inner surface of the subterranean well.

The method further includes inserting the deployment device and the ring into the subterranean well. The ring may be positioned on the deployment device in a first orientation that allows the ring and the deployment device to traverse the subterranean well. The method further includes delivering the deployment device, the load ring, and the energizing ring to a setting location in the subterranean well. Once at the setting location, the method includes activating the deployment device to move the outer surface of the energizing ring to contact the inner surface of the load ring to enlarge the outer circumference of the load ring in a radial direction. This causes the outer surface of the load ring to seal to an inner surface of the subterranean well at the setting location.

In this method, the circuitous path of the slot may include a first portion that runs parallel to the central axis at the front face, a second portion that runs parallel to the central axis at the back face, and a third portion that runs perpendicular to the central axis at one or more locations between the front face and the back face. The circuitous path may also include at least one portion that is oriented at an angle to the central axis. In addition, the outer surface of the load ring may include a textured surface configured to engage and grip the inner surface of the subterranean well. The textured surface may also include a particulate configured to increase the friction force between the load ring and the subterranean well. Alternatively, the outer surface of the load ring may include at least one shoulder extending to or above the textured surface to engage and grip the inner surface of the subterranean well.

In this method, the inner surface of the load ring may include a convex surface relative to the central axis of the load ring, and the outer surface of the energizing ring may include a tapered surface relative to the central axis of the energizing ring. Alternatively, the inner surface of the load ring may include a tapered surface relative to the central axis of the load ring, and the outer surface of the energizing ring may include a convex surface relative to the central axis of the energizing ring. In addition, the load ring, the energizing ring, or both the load ring and energizing ring may be made of a material that galvanically corrodes in a subterranean well. Similarly, the load ring, the energizing ring, or both the load ring and energizing ring may be made of a material that disintegrates or dissolves as a result of an interaction with a fluid in a subterranean well. The load ring, the energizing ring, or both the load ring and energizing ring may also include a composite material.

The load ring in this method may be an assembly of two or more rings interlocked together. Each load ring may have a slot extending through the entire wall thickness from the front face of the ring to the back face of the ring. The circuitous path of the load ring may be formed by orienting the slot of at least one ring at a different angular orientation to the adjacent ring so that the slots of each ring do not overlap when the load ring is enlarged by the energizing ring.

According to another embodiment, the specification provides a subterranean well assembly. The subterranean well has an inner surface at a setting location, which may be defined by casing. The subterranean well also includes a load ring and an energizing ring. The load ring includes an outer surface having an outer circumference, an inner surface, a central axis, and a wall having a wall thickness. The wall includes at least one slot extending through the entire wall thickness, and the slot follows a circuitous path from the front face of the load ring to the back face of the load ring. The slot has a first inner surface and a second inner surface, and a portion of the first inner surface and a portion of the second inner surface are configured to contact one another when the outer circumference of the load ring is enlarged.

The energizing ring includes an outer surface, an inner surface, and a central axis. The outer surface of the energizing ring is configured to contact the inner surface of the load ring and to enlarge the outer circumference of the load ring in a radial direction. This causes the outer surface of the load ring to seal to an inner surface of the subterranean well at the setting location.

In this embodiment, the circuitous path of the slot may include a first portion that runs parallel to the central axis at the front face, a second portion that runs parallel to the central axis at the back face, and a third portion that runs perpendicular to the central axis at one or more locations between the front face and the back face. The circuitous path may also include at least one portion that is oriented at an angle to the central axis. In addition, the outer surface of the load ring may include a textured surface configured to engage and grip the inner surface of the subterranean well. The textured surface may also include a particulate configured to increase the friction force between the load ring and the subterranean well. In another embodiment, the outer surface of the load ring may include at least one shoulder extending to or above the textured surface to engage and grip the inner surface of the subterranean well.

In this embodiment, the inner surface of the load ring may include a convex surface relative to the central axis of the load ring, and the outer surface of the energizing ring may include a tapered surface relative to the central axis of the energizing ring. In another embodiment, the inner surface of the load ring may include a tapered surface relative to the central axis of the load ring, and the outer surface of the energizing ring may include a convex surface relative to the central axis of the energizing ring. In addition, the load ring, the energizing ring, or both the load ring and energizing ring may be made of a material that galvanically corrodes in a subterranean well. Similarly, the load ring, the energizing ring, or both the load ring and energizing ring may be made of a material that disintegrates or dissolves as a result of an interaction with a fluid in a subterranean well. The load ring, the energizing ring, or both the load ring and energizing ring may also include a composite material.

The load ring may be an assembly of two or more rings interlocked together. Each load ring may have a slot extending through the entire wall thickness from a front face of the ring to a back face of the ring. The circuitous path of the load ring may be formed by orienting the slot of at least one ring at a different angular orientation to the adjacent ring so that the slots of each ring do not overlap when the load ring is enlarged by the energizing ring.

DRAWINGS

The drawings accompanying and forming part of this specification are included to depict certain aspects of embodiments of the invention. A clearer impression of embodiments of the invention, and of the components and operation of systems provided with embodiments of the invention, will become more readily apparent by referring to the exemplary, and therefore non-limiting, embodiments illustrated in the drawings, wherein identical reference numerals designate the same components. Note that the features illustrated in the drawings are not necessarily drawn to scale.

DETAILED DESCRIPTION

This disclosure and the various features and advantageous details thereof are explained more fully with reference to the non-limiting embodiments that are illustrated in the accompanying drawings and detailed in the following description. Descriptions of well-known starting materials, processing techniques, components and equipment are omitted so as not to unnecessarily obscure the disclosure in detail. Skilled artisans should understand, however, that the detailed description and the specific examples, while disclosing preferred embodiments, are given by way of illustration only and not by way of limitation. Various substitutions, modifications, additions or rearrangements within the scope of the underlying inventive concept(s) will become apparent to those skilled in the art after reading this disclosure.

Figure 1:
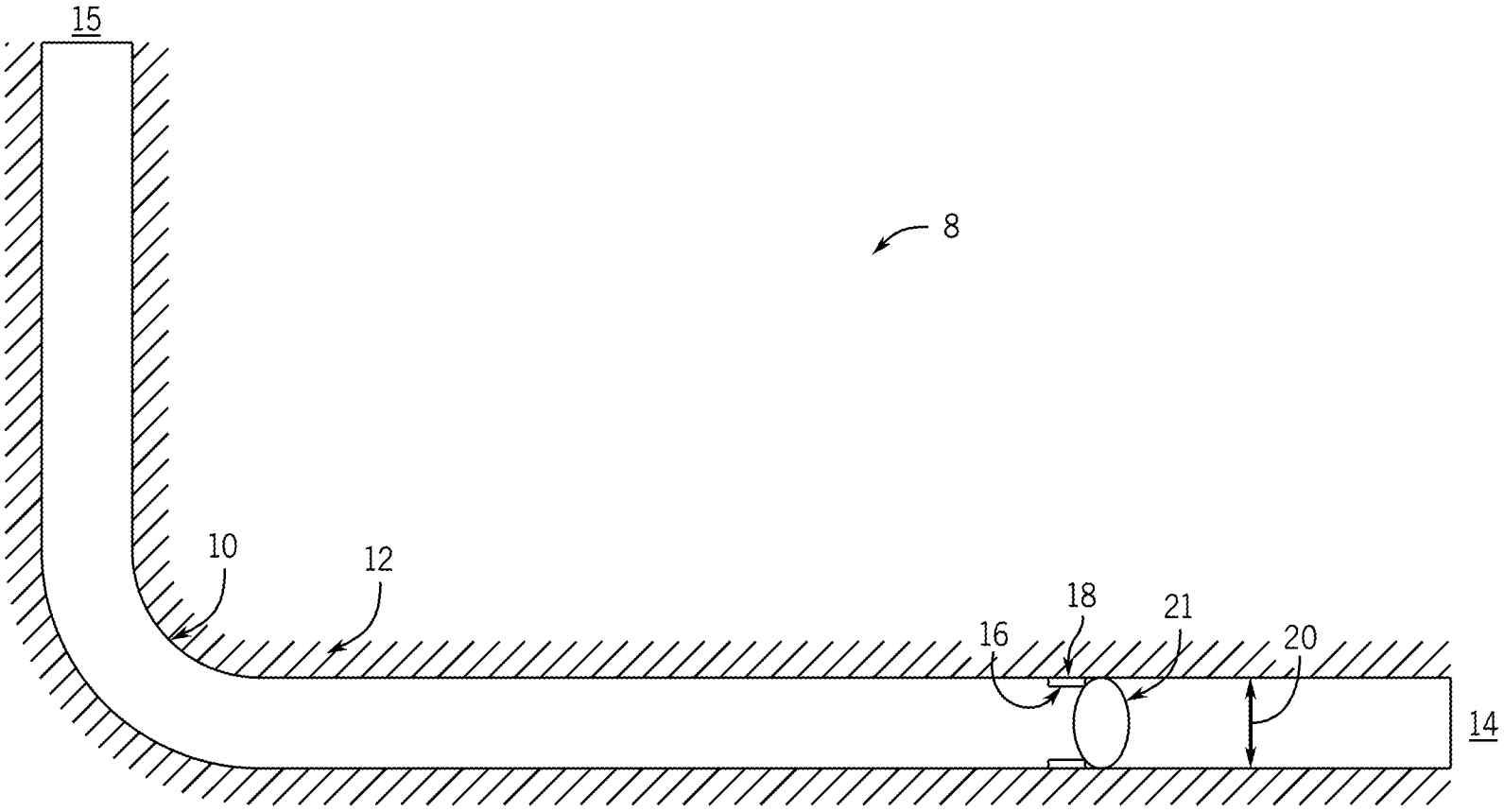
FIG. 1 is a diagrammatic representation of a schematic view through a subterranean well with a roll-out apparatus installed therein.

FIG. 1 illustrates subterranean well 8 having wellbore 10 located in formation 12. Subterranean well 8 includes downhole end 14 and uphole end 15. FIG. 1 further illustrates roll-out apparatus 16, which includes a load ring and energizing ring, installed or deployed in subterranean well 8. Roll-out apparatus 16 is installed or deployed at setting location 18. Wellbore 10 has inner diameter 20 that has inner surface 21 at setting location 18. As will be discussed in more detail below, roll-out apparatus 16 is deployed from the surface of well 8 via a deployment device to setting location 18. When roll-out apparatus 16 is at setting location 18, roll-out apparatus 16 engages inner surface 21 by enlarging the outer circumference of a load ring. The load ring's outer circumference is enlarged by moving an energizing ring so that the outer surface of the energizing ring contacts the inner surface of the load ring. It is the enlarging of the load ring to the inner surface 21 of subterranean well 8 that engages roll-out apparatus 16 in subterranean well 8 at setting location 18.

Setting location 18 may be at any location in subterranean well 8, and roll-out apparatus 16 may be configured for the setting location based on the inner diameter or inner circumference of the subterranean well. One advantage of the invention is that roll-out apparatus 16 may operate in several types of wellbores. For example, those skilled in the art will also appreciate that roll-out apparatus 16 may also be set in sections of a wellbore that do not contain any tubulars. These sections are generally known to the industry as open hole. In this instance, roll-out apparatus 16 will interact with the exposed geological formation.

FIG. 1 illustrates a single roll-out apparatus deployed at a single setting location, however, those skilled in the art will understand that the invention is not limited to a single roll-out apparatus or a single setting location. Multiple roll-out apparatus may be deployed at one setting location and/or multiple roll-out apparatus may be deployed at multiple setting locations. Furthermore, a single roll-out apparatus may be adjusted and reconfigured to be deployed at a first setting location and then later uninstalled and possibly deployed at a second setting location. Roll-out apparatus 16 may be made of a material that galvanically corrodes in subterranean well 8 or made of a material that disintegrates or dissolves as a result of an interaction with a fluid in subterranean well 8. Examples of these materials include but are not limited to: an Aluminum alloy that could dissolve through interaction with hydrochloric acid, degradable magnesium alloy, or composite material made with degradable elastomers that dissolve through interaction with water based fluids. Roll-out apparatus 16 may also be made of a composite material.

FIGS. 2-5 illustrate views of an embodiment of load ring 22. In this embodiment, load ring 22 is tubular in shape having a central axis 24, outer surface 26, and outer circumference 28. The load ring also has front face 32 and back face 34. The load ring has wall thickness 25 that is determined by outer surface 26 and inner surface 30, with slot 36 extending through the entire wall thickness. Slot 36 follows a circuitous path 38 from front face 32 of the load ring to back face 34 of the load ring. Slot 36 further includes a first inner surface 46 and a second inner surface 48. Load ring 22 is configured so that a portion 50 of the first inner surface 46 and a portion 52 of the second inner surface 48 are configured to contact one another when the outer circumference 28 of the load ring is enlarged.

Figure 7:
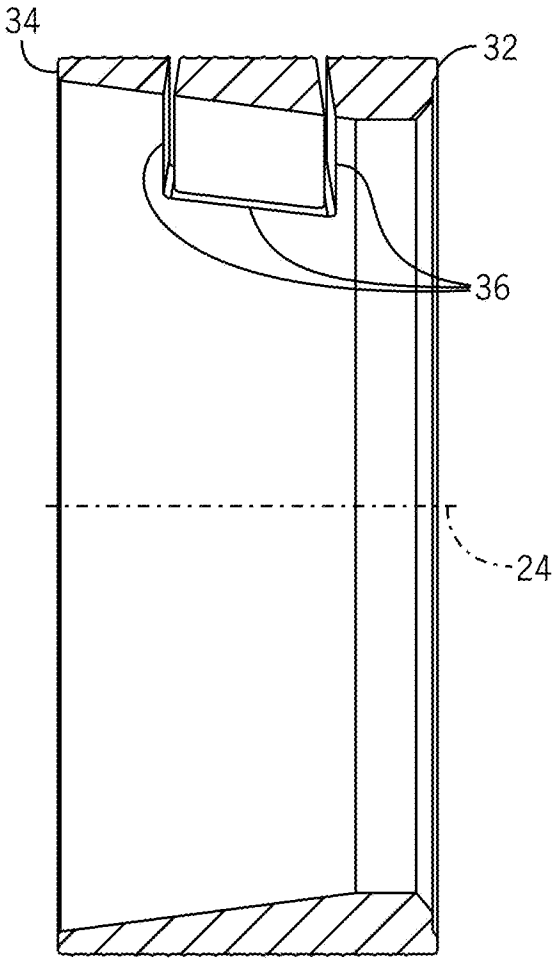
FIG. 7 is a cross-sectional view of the load ring of FIG. 6, viewed along line 7-7.
Figure 6:
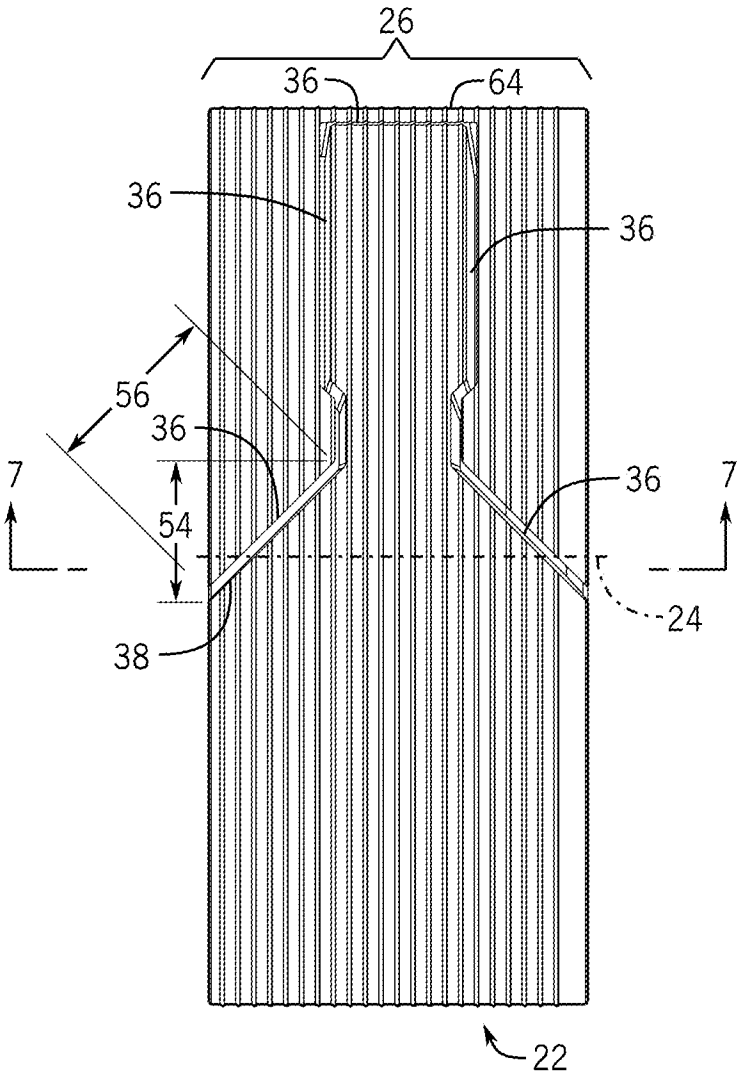
FIG. 6 is a perspective view of an alternate embodiment of a load ring.
Figure 8:
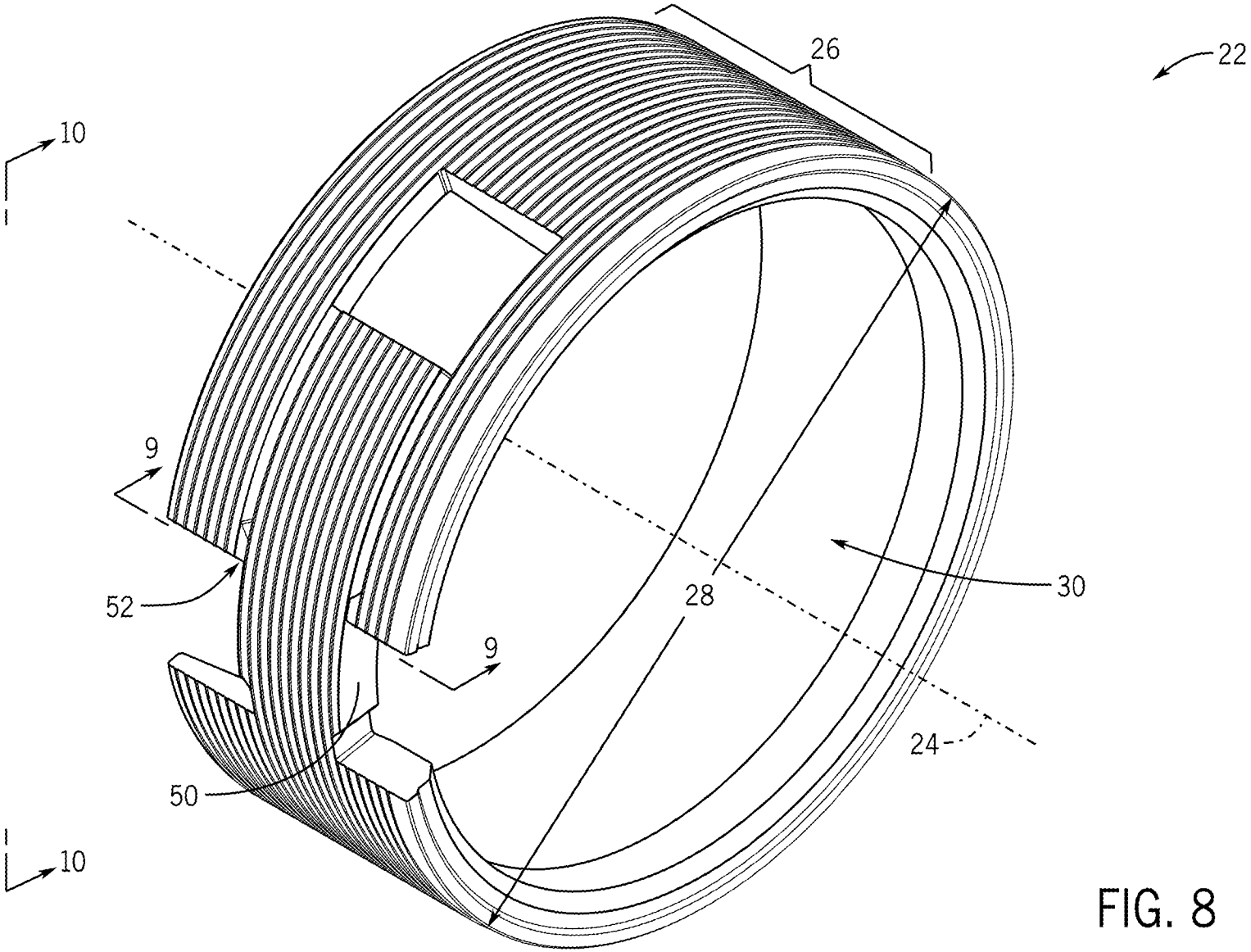
FIG. 8 is a perspective view of a load ring when the load ring is enlarged.
Figure 11:
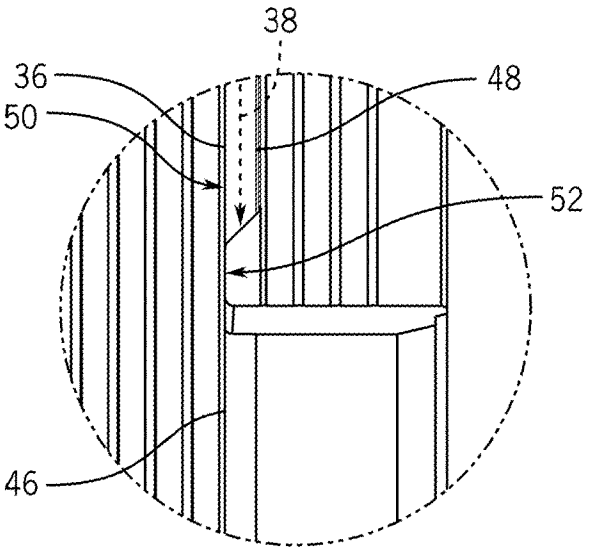
FIG. 11 is an enlarged view of a portion of the load ring of FIG. 10.
Figure 10:
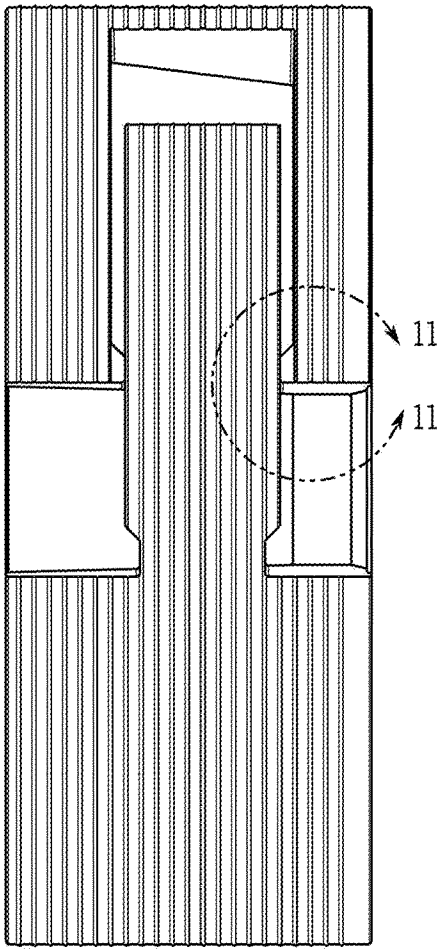
FIG. 10 is an elevational view of the load ring of FIG. 8, viewed along line 10-10.
Figure 9:
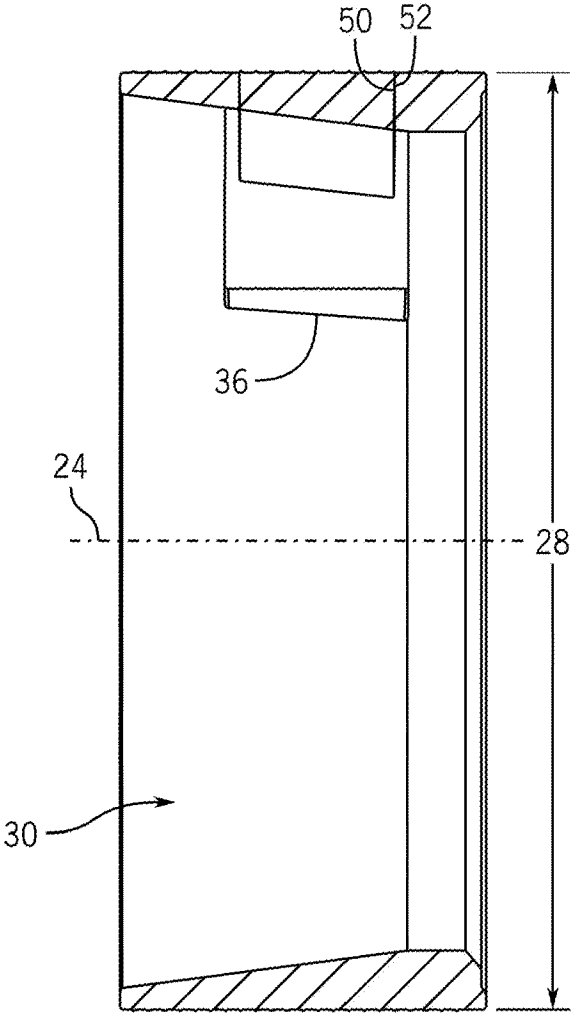
FIG. 9 is a cross-sectional view of the load ring of FIG. 8, viewed along line 9-9.

In one embodiment, slot 36 includes first portion 40 that runs parallel to central axis 24 at front face 32, second portion 42 that runs parallel to the central axis 24 at back face 34, and third portion 44 that runs perpendicular to central axis 24 at one or more locations between front face 32 and back face 34. Slot 36 is illustrated in FIGS. 2-5 as having a rectangular shape, but the invention is not limited to this particular slot geometry and may include any functional shape, and by no means is limited to a rectangular shape, either in part or in whole. For example, FIGS. 6-7 illustrate one possible alternative shape of slot 36. In this embodiment, circuitous path 38 of slot 36 includes at least one portion 56 that is oriented at angle 54 to central axis 24. Angle 54 may be any angle that enables the load ring to function.

Furthermore, FIGS. 2-7 illustrate slot 36 as having straight or linear portions 40, 42, 44, 56. However, the invention is not limited to straight or linear portions and may include non-linear portions, in part or in whole. A person of ordinary skill in the art would understand that slot 36 may be formed using a number of manufacturing techniques and is not limited to any specific manufacturing technique. Slot 36 enables load ring 22 to roll-out or enlarge by bending when energized on inner surface 30 of the load ring. It should be noted that the bending aspect of the invention does not mean that the load ring will not experience plastic deformation. Indeed, the load ring may experience deformation. Instead, it only indicates that the load ring is not required to stretch.

As mentioned, load ring 22 includes an inner surface 30 that may include first portion 58, second portion 60, and third portion 62. First portion 58 may include a chamfer and second portion 60 may include a flat portion 61, which may facilitate positioning and maintaining load ring 22 on a deployment device. As will be discussed in more detail below, third portion 62 is the portion of inner surface 30 that is contacted by the energizing ring to enlarge circumference 28 in a radial direction thereby causing the outer surface of the load ring to contact an inner surface of the subterranean well at the setting location. Third portion 62 of inner surface 30 may include a non-linear shape relative to the central axis 24. For example, third portion 62 may include a convex surface relative to central axis 24. In an alternative embodiment, third portion 62 may include a tapered surface relative to central axis 24.

In these exemplary embodiments, wall thickness 25 decreases in third portion 62 when moving along central axis 24 from front face 32 to back face 34. A person or ordinary skill in the art would understand that the invention is not limited to a particular wall thickness. Similarly, a person or ordinary skill in the art would understand that third portion 62 is not limited to a particular shape and may include a combination of linear and non-linear shapes, or any shape that provides a contact surface or point for the energizing ring.

Figure 2:
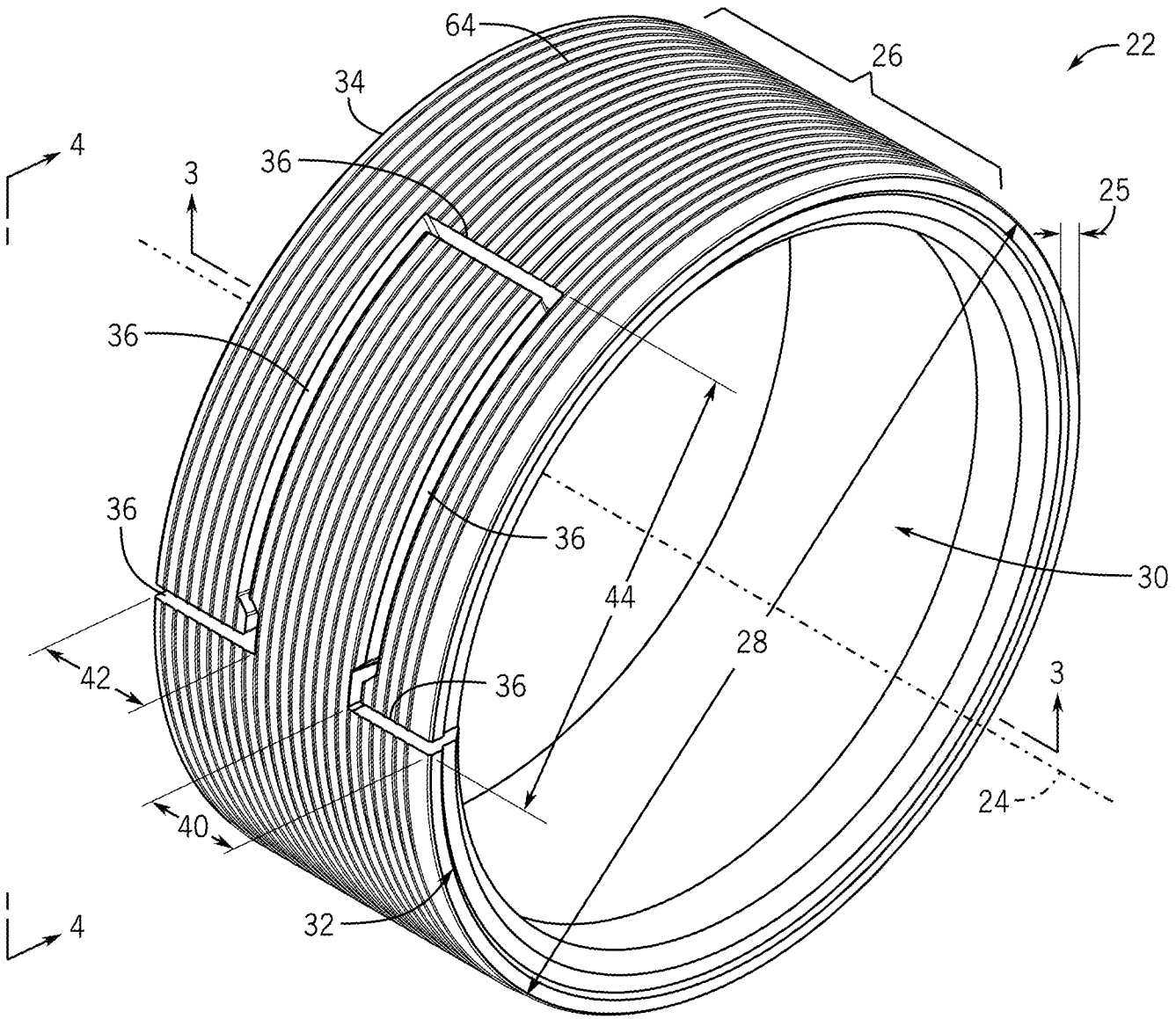
FIG. 2 is a perspective view of a load ring.
Figure 5:
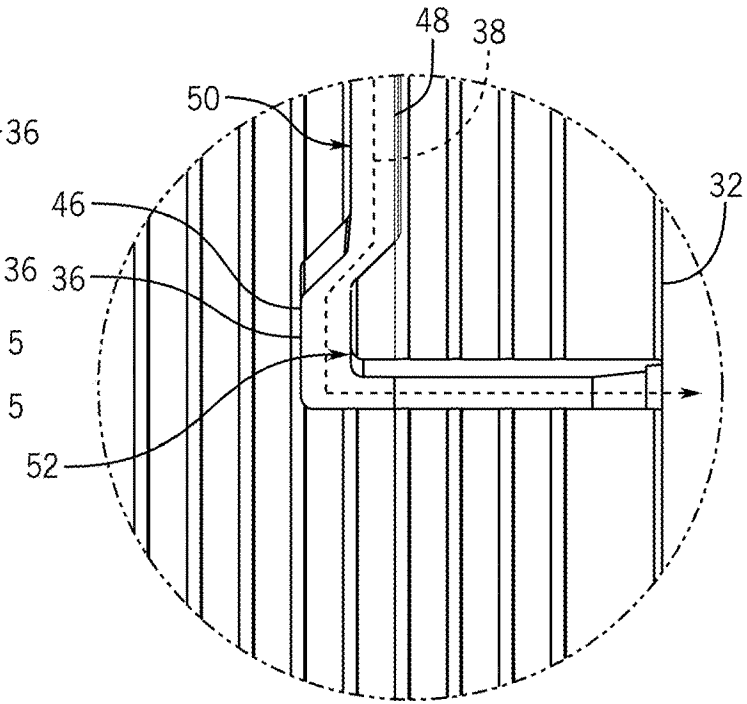
FIG. 5 is an enlarged view of a portion of the load ring of FIG. 4.
Figure 4:
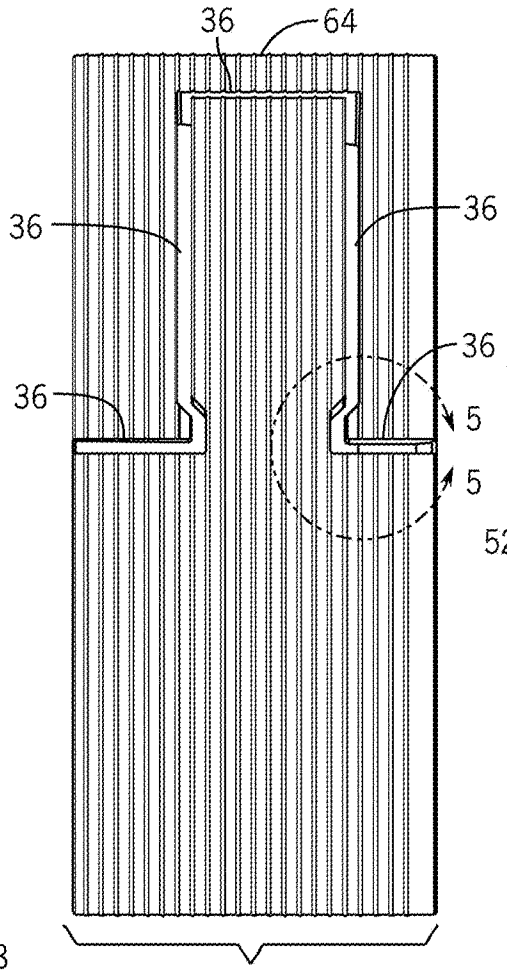
FIG. 4 is an elevational view of the load ring of FIG. 2, viewed along line 4-4.
Figure 3:
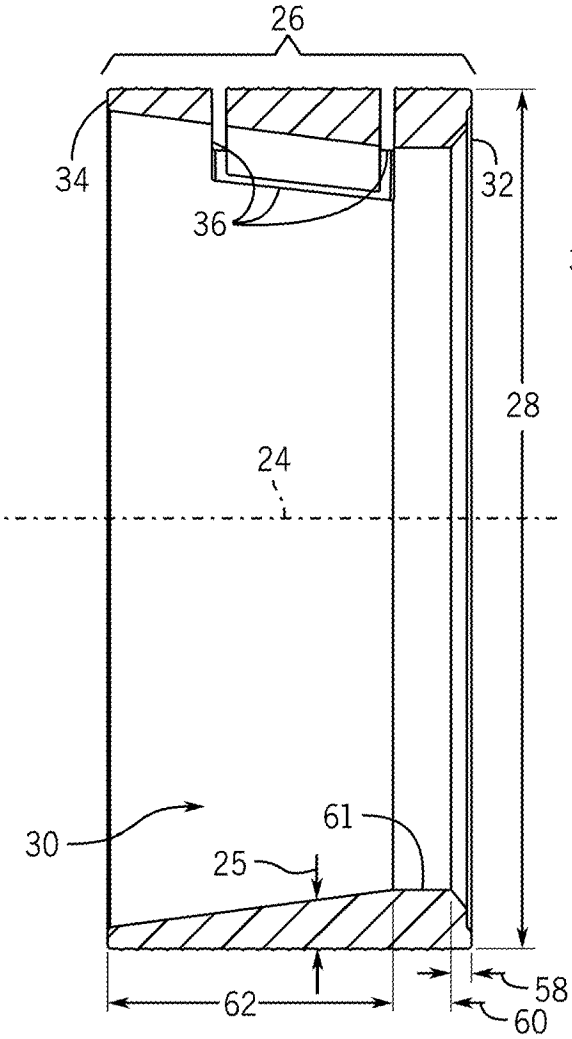
FIG. 3 is a cross-sectional view of the load ring of FIG. 2, viewed along line 3-3.

As illustrated in FIGS. 2, 4, and 6, outer surface 26 of load ring 22 may include textured surface 64 configured to engage the inside surface of the subterranean well. Textured surface 64 may enhance gripping and/or sealing to the wellbore walls. Such enhancements may include but are not limited to: (1) particles such as silicon carbide (SiC) attached to the outer surface, which are harder than the material of the wellbore wall and/or the roll-out. Attachment of these particles may increase the friction force between the load ring and the subterranean well and can be accomplished using an epoxy or resin or other methods including but not limited to: (1) sintering; (2) arc spray depositing systems, (3) profiles machined or attached to the outer surface (the profiles may be treated to increase their hardness); and (4) sealing systems such as elastomers or thermo plastics bonded to the roll-out. A person of ordinary skill in the art would understand that the present invention is not limited to the textured surface described, and may include a number of different surfaces, including but not limited to, tooth, knurls, tapered surface or combination thereof. The textured surface is intended to increase the friction force between the load ring and the subterranean well, and the invention is not limited to the disclosed embodiments.

FIGS. 8-11 illustrate load ring 22 when outer circumference 28 is enlarged via an energizing ring contacting inner surface 30 of load ring 22. When this occurs, portion 50 of first inner surface 46 moves relative to portion 52 of second inner surface 48, which results in portion 50 contacting portion 52. This contact may provide a seal thereby closing slot 36 and circuitous path 38. Those skilled in the art will appreciate that seal or sealing means that the leak rate is sufficiently low to allow fluids to be diverted into the formation above the roll-out apparatus. In other words, a 100% seal may be accomplished, but is not required to provide full functionality.

In addition, the illustrated embodiment includes a ramp shape for portion 52. A person of ordinary skill in the art would understand that contact between portion 50 and 52 may be accomplished using a number of other shapes or configurations, and is not limited to the illustrated embodiment. For example, slot 36 may be created by a shearing press resulting in a completely flat first inner surface 46 and second inner surface 48, where the inner and outer surface maintain contact with each other during and after enlarging of the circumference.

Figure 13:
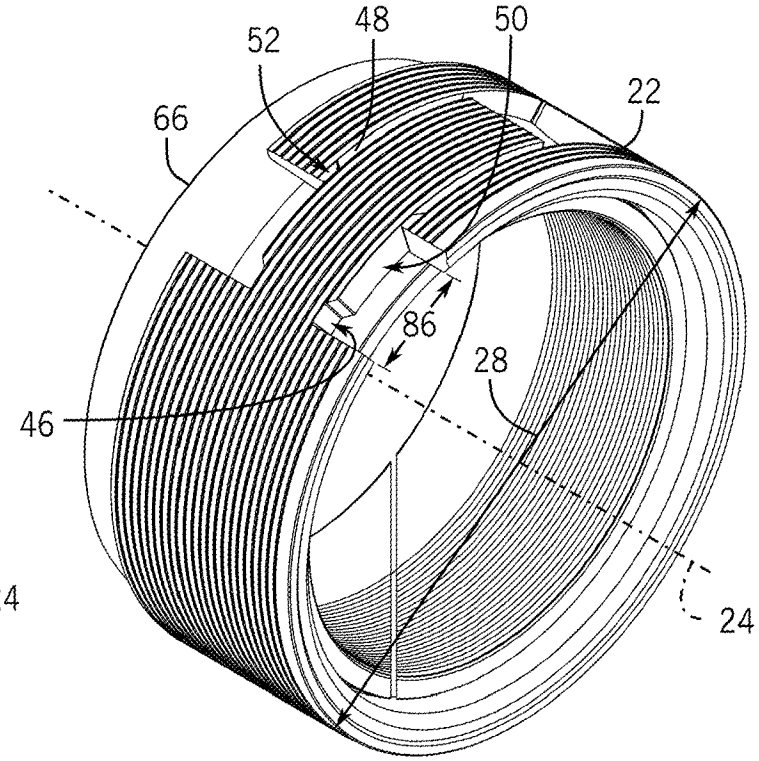
FIG. 13 is a perspective view of the energizing ring of FIG. 12 positioned inside the load ring of FIG. 12.
Figure 12:
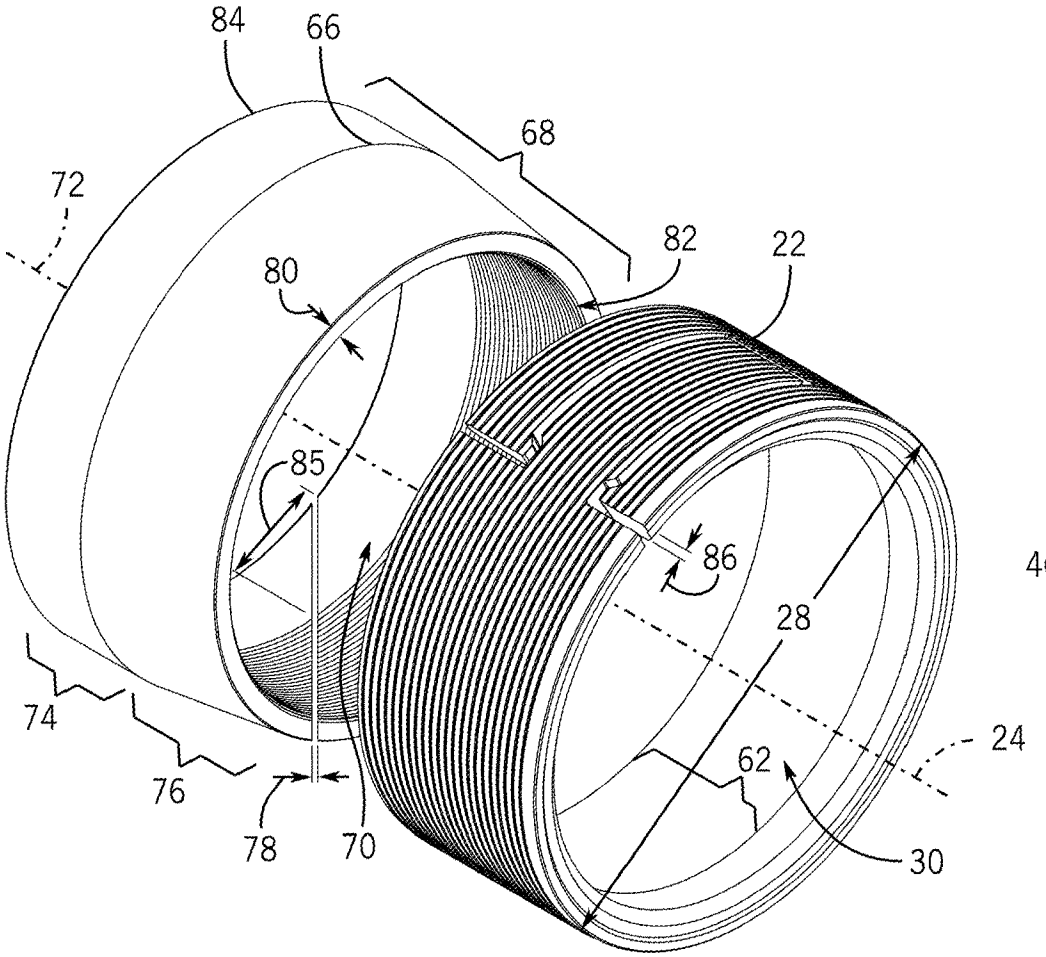
FIG. 12 is a perspective view of a load ring and an energizing ring.

FIGS. 12 & 13 illustrate exemplary load ring 22 of FIGS. 2-5 and energizing ring 66. FIG. 12 illustrates energizing ring 66 coaxially aligned with load ring 22, but not in contact with load ring 22. Energizing ring 66 includes an outer surface 68, an inner surface 70, and a central axis 72. Outer surface 68 is configured to contact inner surface 30 of load ring 22 and to enlarge outer circumference 28 of the load ring in a radial direction. This contact may provide a seal between load ring 22 and energizing ring 66. As discussed, those skilled in the art will appreciate that seal or sealing means the leak rate is sufficiently low to allow fluids to be diverted into the formation above the roll-out apparatus. In other words, a 100% seal may be accomplished, but is not required to provide full functionality.

Outer surface 68 of energizing ring 66 may include a first portion 74 and a second portion 76. First portion 74 may be a flat surface, and second portion 76 of outer surface 68 may include a tapered surface relative to central axis 72. Tapered surface 76 is configured to contact third portion 62 of inner surface 30 of load ring 22. In an alternative embodiment, second portion 76 may include a non-liner surface relative to central axis 72. For example, second portion 76 may include a convex surface relative to central axis 72. A person or ordinary skill in the art would understand that second portion 76 is not limited to a particular shape and may include a combination of linear and non-linear shapes, or any shape that provides a contact surface to engage inner surface 30 of load ring 22.

Energizing ring 66 may also include slot 78 extending through wall thickness 80 of energizing ring 66. As illustrated, slot 78 extends from front face 82 to back face 84 of energizing ring 66. Slot 78 may be parallel with central axis 72, or it may be oriented at angle 85 from central axis 72. Moreover, single slot 78 is only one exemplary embodiment, and other embodiments of the invention may include one or more slots that do not extend the full length of outer surface 68, but instead extend only a portion of the length of outer surface 68.

FIG. 13 illustrates energizing ring 66 engaged in load ring 22 to enlarge outer circumference 28 of load ring 22 in a radial direction. As illustrated in FIGS. 8-11, outer circumference 28 is enlarged when second portion 76 of energizing ring 66 contacts inner surface 30 of load ring 22. When this occurs, portion 50 of first inner surface 46 of slot 36 moves relative to portion 52 of second inner surface 48 of slot 36, which results in portion 50 coming into contact with portion 52. This contact may provide a seal thereby closing slot 30 and circuitous path 38. Furthermore, an increase in the size of outer circumference 28 is indicated by the increase in size of gap 86. The further energizing ring 66 is advanced into load ring 22, the larger outer circumference 28 of load ring 22 becomes, as indicated by an increase in the size of gap 86. As illustrated and discussed above, outer circumference 28 of load ring 22 is enlarged by bending or is rolled open. This makes it easier to energize the load ring, which enhances the gripping and sealing of the load ring. This enhanced gripping and sealing is not only during the initial setting and deployment of the load ring, but may increase during the actual fracking or stimulation.

Figure 15:
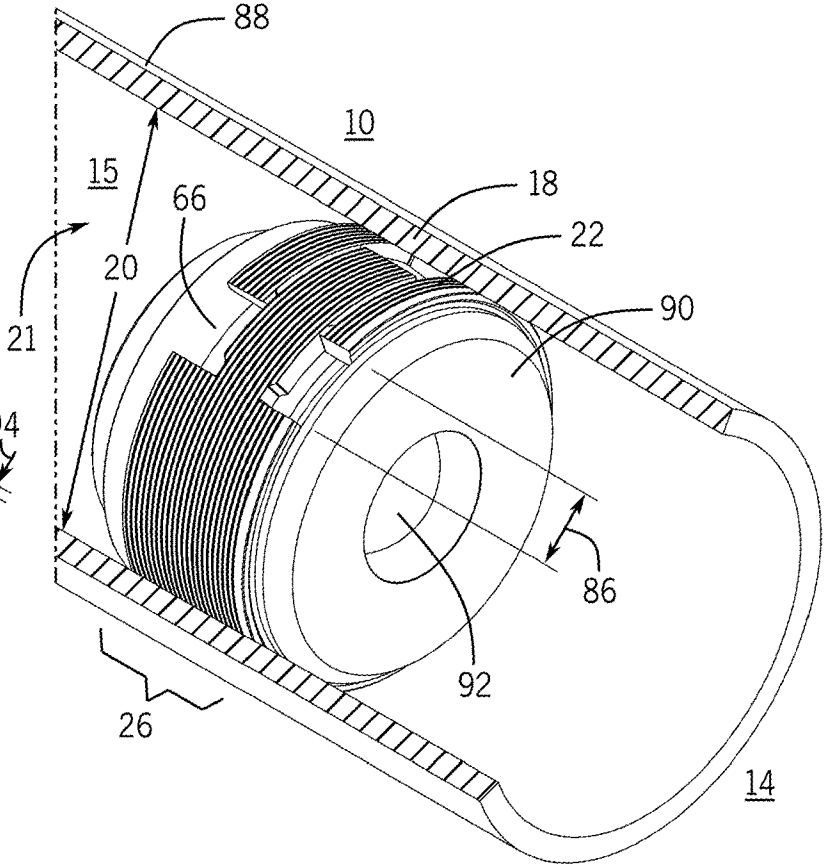
FIG. 15 is a perspective view of the energizing ring of FIG. 14 positioned inside the load ring of FIG. 14.
Figure 14:
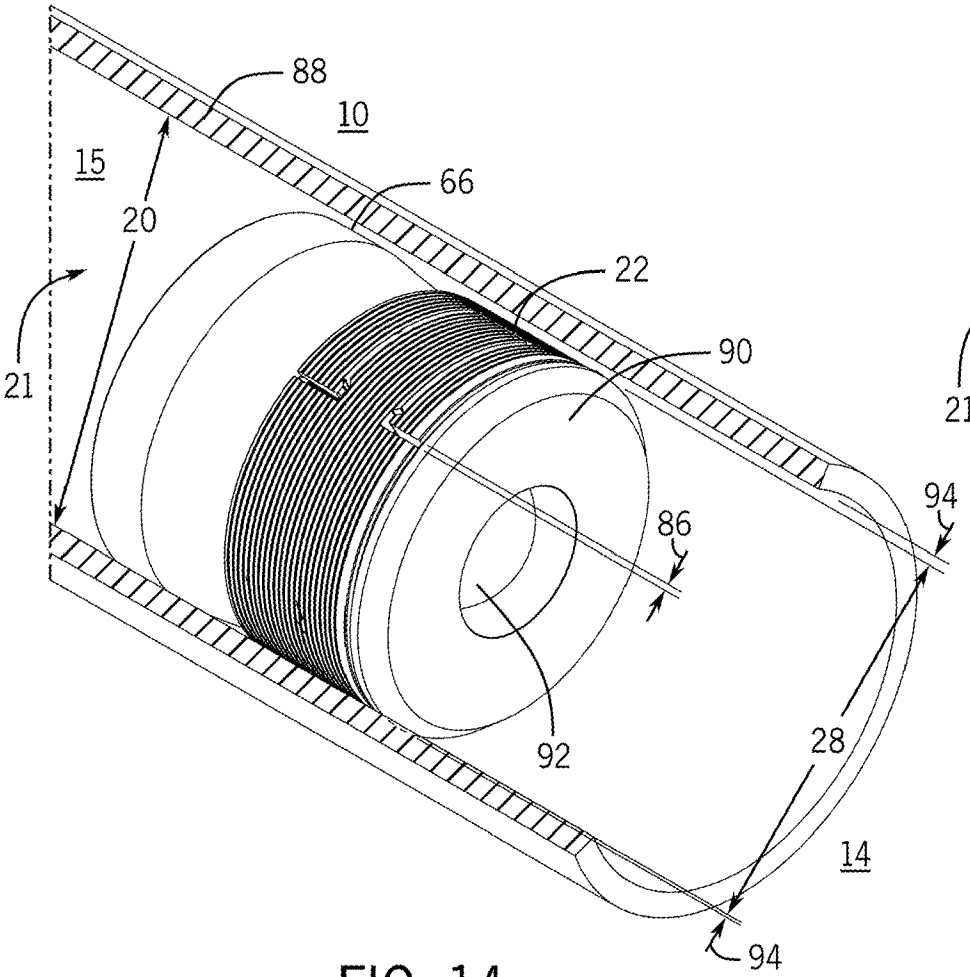
FIG. 14 is a perspective view of a load ring, an energizing ring, a core, and a ball positioned inside a tubular.

FIGS. 14 & 15 are perspective views of the load ring 22 and energizing ring 66 inside tubular 88 located in wellbore 10, which has a downhole end 14 and an uphole end 15. Tubular 88 has an inner diameter 20 and an inner surface 21. FIGS. 14 & 15 also illustrate a core 90 and ball 92 sealing on an internal profiles of the core. In FIG. 14, energizing ring 66 is not energizing or significantly energizing load ring 22. In other words, outer circumference 28 of load ring 22 is not enlarged or significantly enlarged, as indicated by the size of gap 86. In addition, outer circumference 28 of load ring 22 is smaller than inner diameter 20 of tubular 88 leaving a gap 94. This allows the load ring and energizing ring to traverse from uphole end 15 to downhole end 14. Energizing ring 66, load ring 22, core 90, and ball 92 may be installed using a deployment device not shown.

In FIG. 15, energizing ring 66, load ring 22, core 90, and ball 92 are shown at setting location 18. The outer surface of energizing ring 66 is contacting the inner surface of load ring 22 to enlarge outer circumference 28 of the load ring in a radial direction thereby causing the outer surface of the load ring to contact an inner surface 21 of the subterranean well 10 at setting location 18. This contact may provide a seal between inner surface 21 of tubular 88 and outer surface 26 of load ring 22, as well a seal between load ring 22 and energizing ring 66. Those skilled in the art will appreciate that seal or sealing means that the leak rate is sufficiently low to allow fluids to be diverted into the formation above the roll-out. In other words, a 100% seal may be accomplished, but is not required to provide full functionality.

The further energizing ring 66 is advanced into load ring 22, the larger outer circumference 28 of load ring 22 becomes, as indicated by an increase in the size of gap 86. As illustrated and discussed above, outer circumference 28 of load ring 22 is enlarged by bending or is rolled open. This makes it easier to energize the load ring, which enhances the gripping and sealing of the load ring. In this scenario, there is no longer gap 94 and the energized load ring 22 is engaged at setting location 18.

Figure 17:
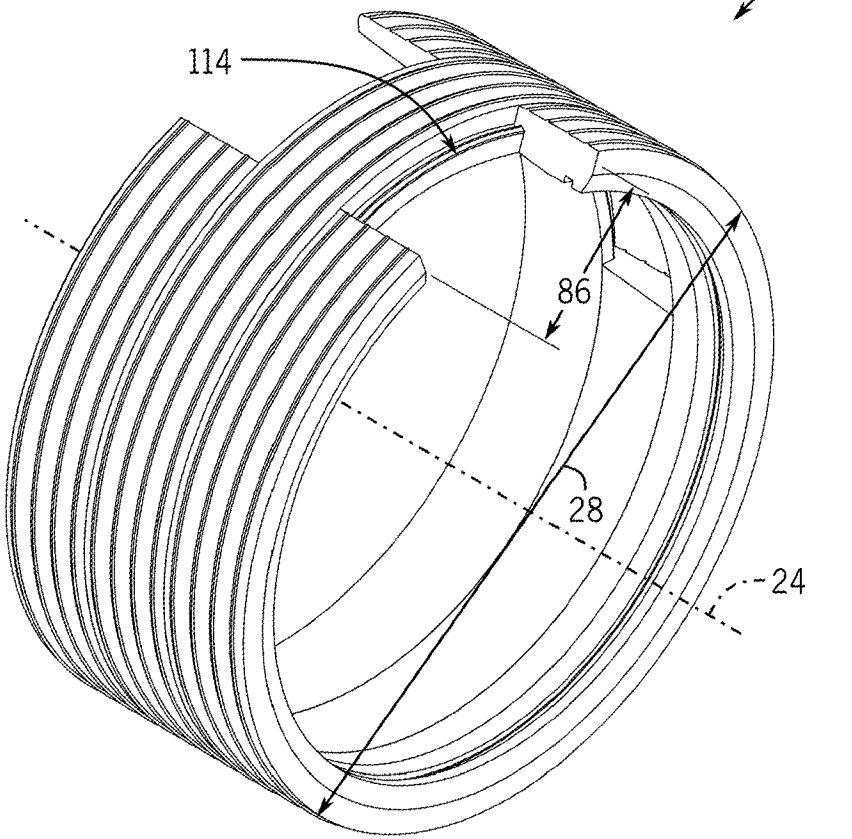
FIG. 17 is a perspective view of the load ring of FIG. 16 when the load ring assembly is enlarged.
Figure 16:
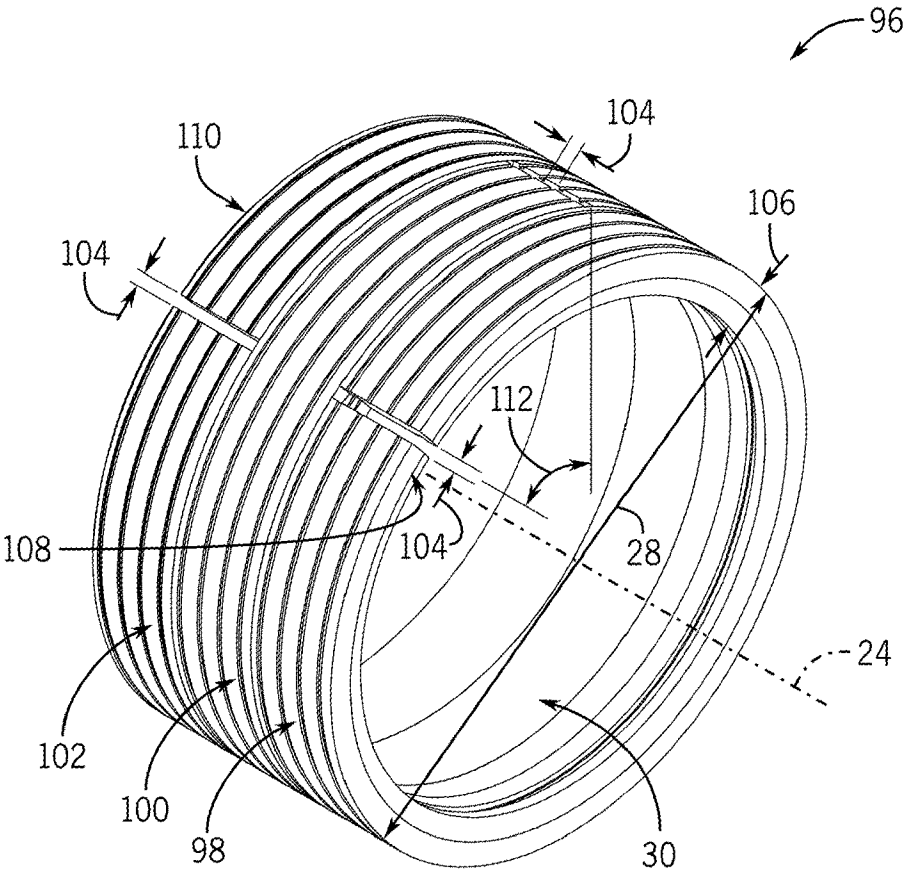
FIG. 16 is a perspective view of a load ring assembly.

FIGS. 16 & 17 are perspective views of load ring assembly 96 that includes first ring 98, second ring 100, and third ring 102 interlocked together. Each ring having a slot 104 extending through the entire wall thickness 106 from front face 108 of the ring to back face 110 of the ring. The circuitous path of load ring assembly 96 is formed by orienting slot 104 of first ring 98 at a different angular orientation 112 to second ring 100 so that slots 104 of each ring do not overlap when the load ring assembly is enlarged by the energizing ring.

Each ring 98, 100, 102 in load ring assembly 96 may be interlocked together using groove configuration 114. Once the rings are interlocked, the groove configuration prevents detachment while still allowing for relative rotating and sliding such that the groove maintains a seal between the rings. To enhance sealing and/or sliding the groove may contain a grease or sealing compound. A person or ordinary skill in the art would understand that there are a number of ways to interlock ring 98, 100, and 102, and the invention is not limited to the illustrated embodiment. Load ring assembly 96 includes an inner surface 30 that is contacted by the energizing ring to enlarge out circumference 28 in a radial direction thereby causing the outer surface of load ring assembly 96 to contact an inner surface of the subterranean well at the setting location. As with load ring 22, inner surface 30 may include a non-linear shape relative to the central axis 24. For example, inner surface 30 may include a convex surface relative to central axis 24.

In an alternative embodiment, inner surface 30 may include a tapered surface relative to central axis 24. In these exemplary embodiments, wall thickness 106 decreases when moving along central axis 24 from front face 108 to back face 110. A person or ordinary skill in the art would understand that the invention is not limited to a particular wall thickness. Similarly, a person or ordinary skill in the art would understand that inner surface 30 is not limited to a particular shape and may include a combination of linear and non-linear shapes, or any shape that provides a contact surface or point for the energizing ring.

FIG. 17 illustrates a perspective views of a load ring assembly 96 when outer circumference 28 is enlarged via an energizing ring contacting inner surface 30 of load ring assembly 90. An increase in the size of outer circumference 28 is indicated by the increase in the size of gap 86. The further the energizing ring is advanced into load ring assembly 96, the larger outer circumference 28 of load ring 96 becomes, as indicated by an increase in the size of gap 86. As illustrated and discussed above, outer circumference 28 of load ring assembly 96 is enlarged by bending or is rolled open. This makes it easier to energize the load ring assembly, which enhances the gripping and sealing of the load ring. This enhanced gripping and sealing is not only during the initial setting and deployment of the load ring, but may increase during the actual tracking or stimulation.

Figure 19:
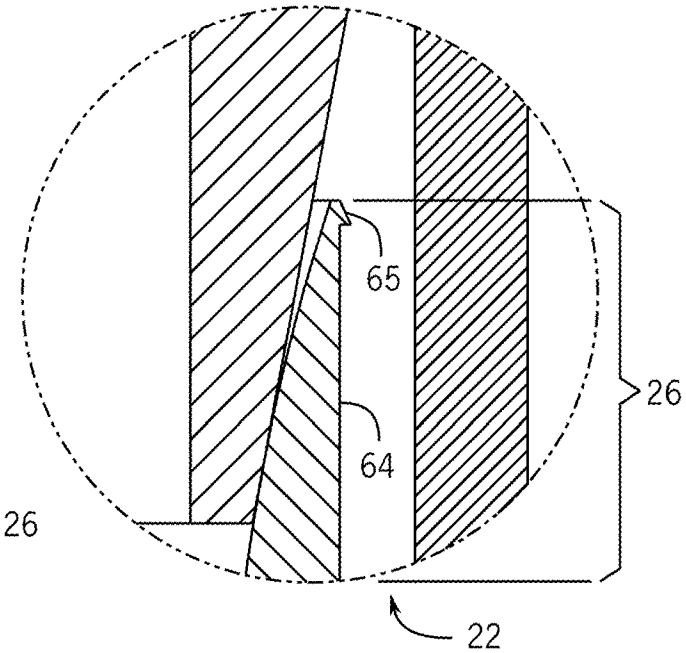
FIG. 19 is an enlarged view of a portion of the load ring and energizing ring of FIG. 18.
Figure 18:
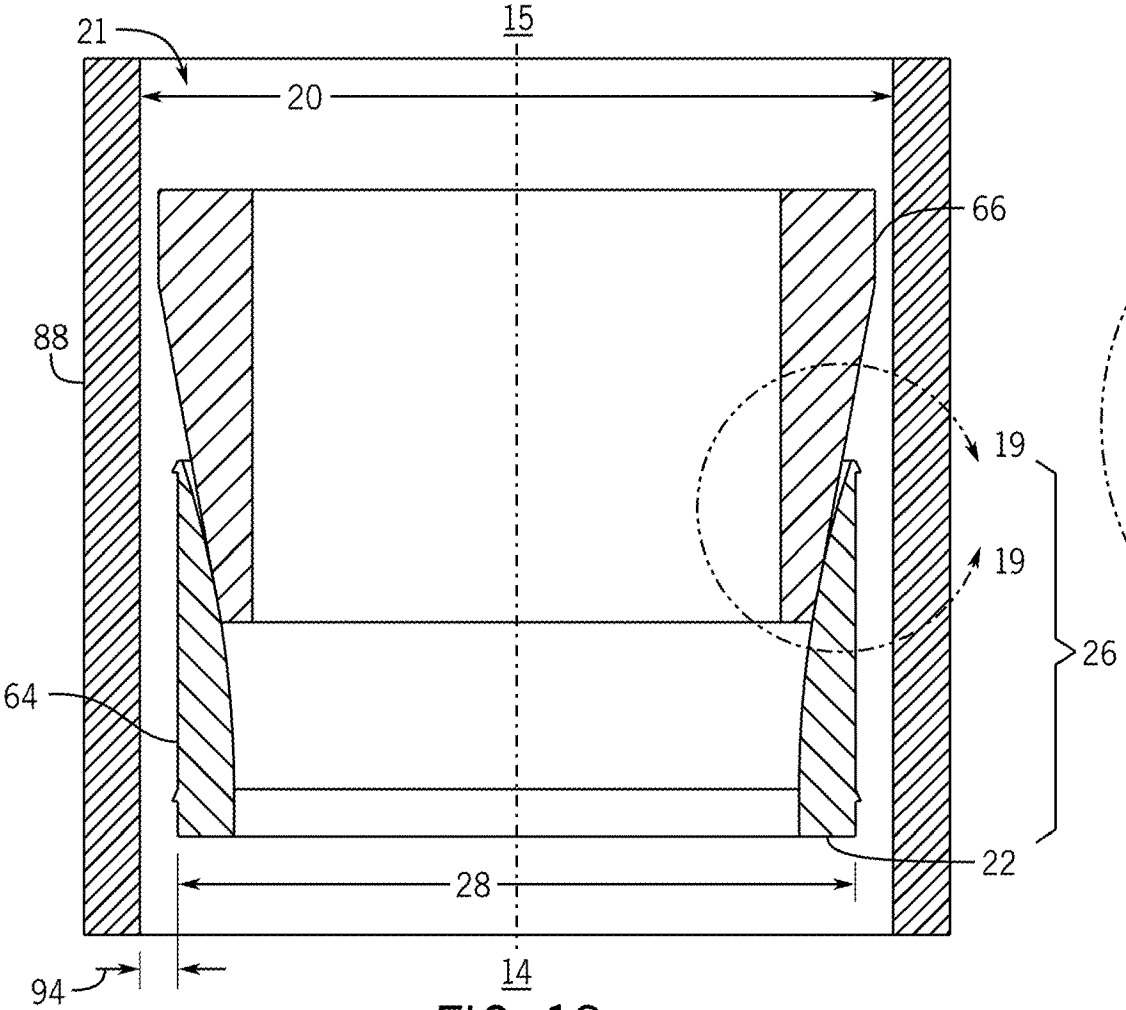
FIG. 18 is a cross-sectional view of a load ring and an energizing ring positioned inside a tubular.
Figure 20:
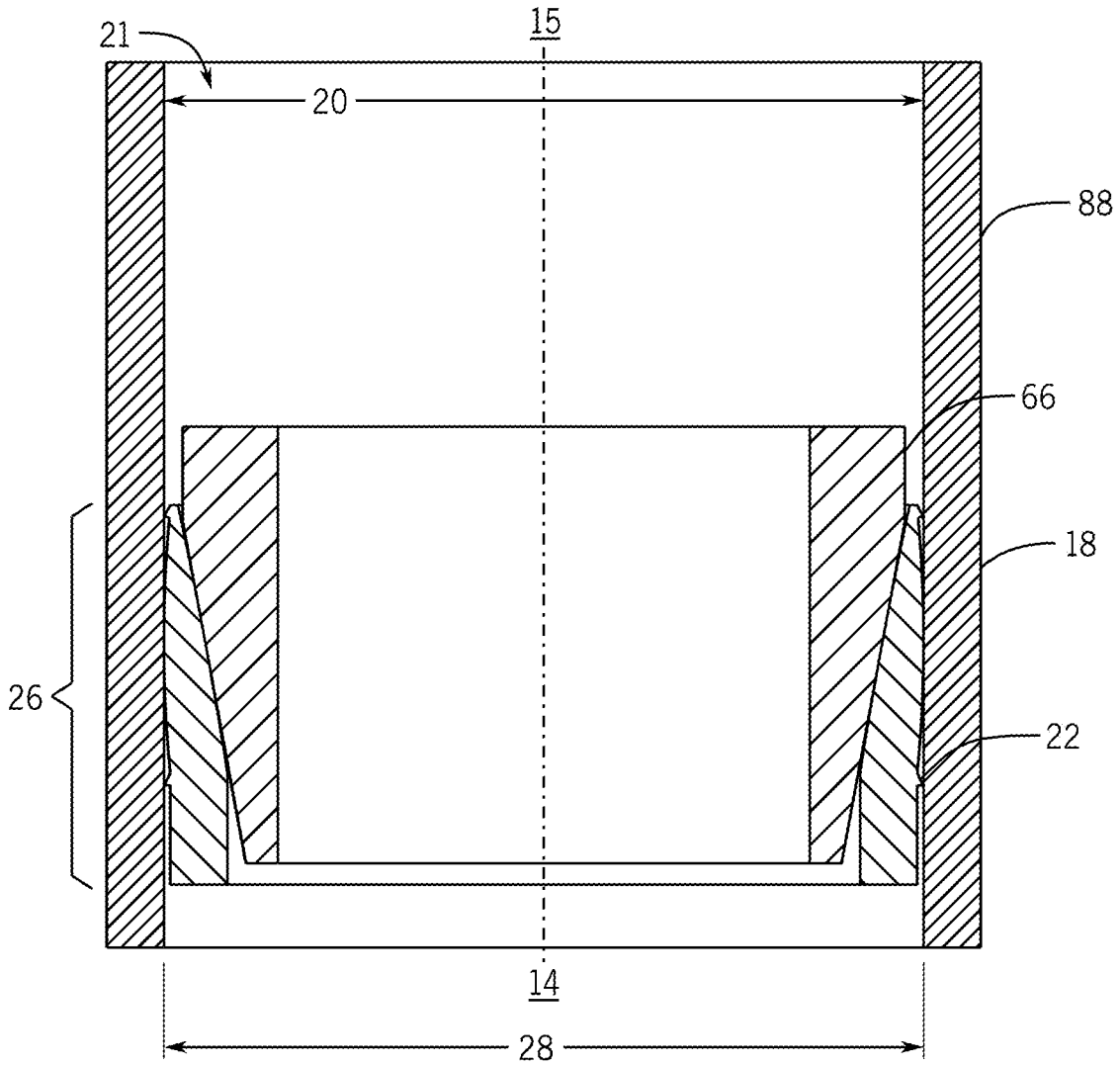
FIG. 20 is a cross-sectional view of the energizing ring of FIG. 18 positioned inside the load ring of FIG. 18.

FIGS. 18-20 are cross-sectional views of load ring 22 and energizing ring 66 inside tubular 88, which has a downhole end 14 and an uphole end 15. Tubular 88 also has inner diameter 20 and inner surface 21. In FIG. 18, energizing ring 66 is shown in a position where it not energizing or significantly energizing load ring 22. In other words, outer circumference 28 of load ring 22 is smaller than inner diameter 20 of tubular 88 leaving a gap 94, which allows the load ring and energizing ring to traverse from uphole end 15 to downhole end 14.

FIGS. 18-20 further illustrate that outer surface 26 may include at least one shoulder extending to or above textured surface 64. For example, shoulder 65 extends to or above textured surface 64. In this embodiment, shoulder 65 includes a surface that engages inner surface 21 of tubular 88 to increase the friction force between the load ring 22 and tubular 88. In FIG. 20, energizing ring 66 and load ring 22 are shown at setting location 18. The outer surface of energizing ring 66 is contacting the inner surface of load ring 22 to enlarge outer circumference 28 of the load ring in a radial direction thereby causing the outer surface of the load ring, including shoulder 65, to contact inner surface 21 of tubular 88 at setting location 18. This contact may provide a seal between inner surface 21 of tubular 88 and outer surface 26 of load ring 22, as well as a seal between load ring 22 and energizing ring 66. The further energizing ring 66 is advanced into load ring 22, the larger outer circumference 28 of load ring 22 becomes, which further increases the friction force at shoulder 65. A person of ordinary skill in the art would understand that the present invention is not limited to the shoulder geometry or shape illustrated, and may include a number of different shapes or geometries. As discussed, including shoulders in outer surface 26 of load ring 22 is intended to increase the friction force between the load ring and the subterranean well. The invention is not limited to the disclosed embodiments.

Figure 21:
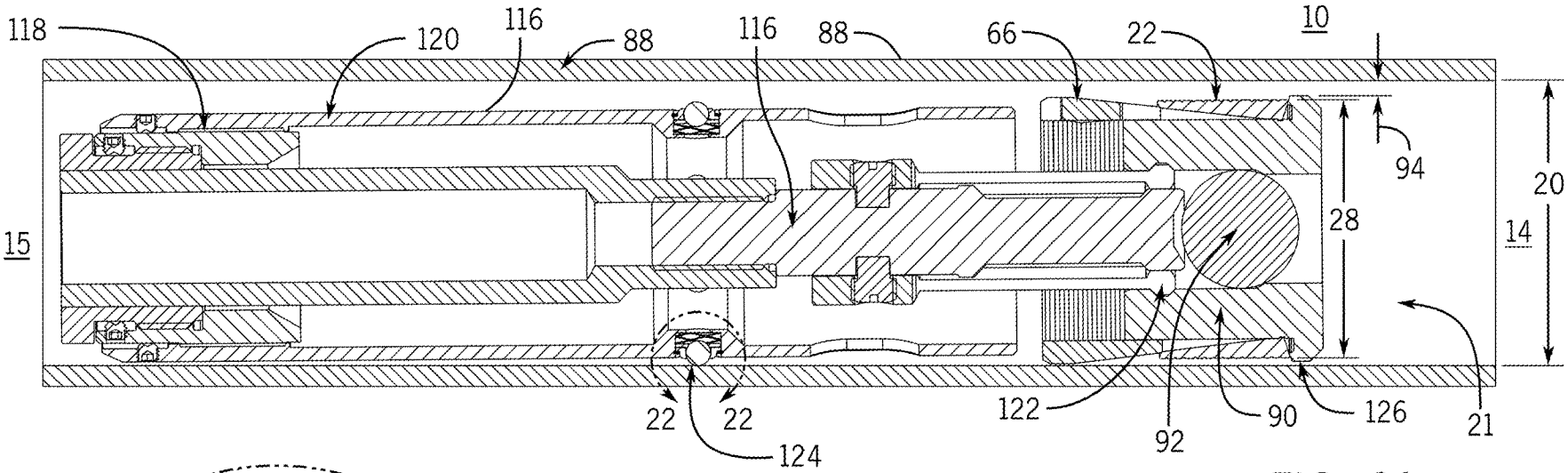
FIG. 21 is a cross-sectional view of a load ring, an energizing ring, a core, and a ball positioned on a deployment device located inside a tubular.

FIG. 21 is a cross-sectional views of energizing ring 66, load ring 22, core 90, and ball 92 are shown inside of tubular 88 positioned on deployment device 116. Tubular 88 has inner diameter 20, inner surface 21, downhole end 14, and uphole end 15. As illustrated, energizing ring 66 is not significantly contacting or significantly energizing load ring 22. In other words, outer circumference 28 of load ring 22 is smaller than inner diameter 20 of tubular 88 leaving a gap 94, which allows the energizing ring 66, load ring 22, core 90, ball 92, and deployment device 116 to traverse from uphole end 15 to downhole end 14 in formation 10.

The illustrated deployment device 116 is attached to a setting tool 118 and includes a setting sleeve 120, a release mechanism 122 and a pivot point 124. The shown deployment device is relatively common for the field of use, except for the addition of several pivot points. When one or more pivot points are touching the tubular wall, the energizing ring 66 and gauge ring 126 will be lifted by the weight of the setting tool 118 and/or other uphole connected devices such that the frictional contact of the energizing ring or gauge ring rubbing against the tubular wall is reduced. FIG. 21 shows the pivot points added to the circumference of the setting sleeve, but they may also be added to another part of the deployment device.

Figure 22:
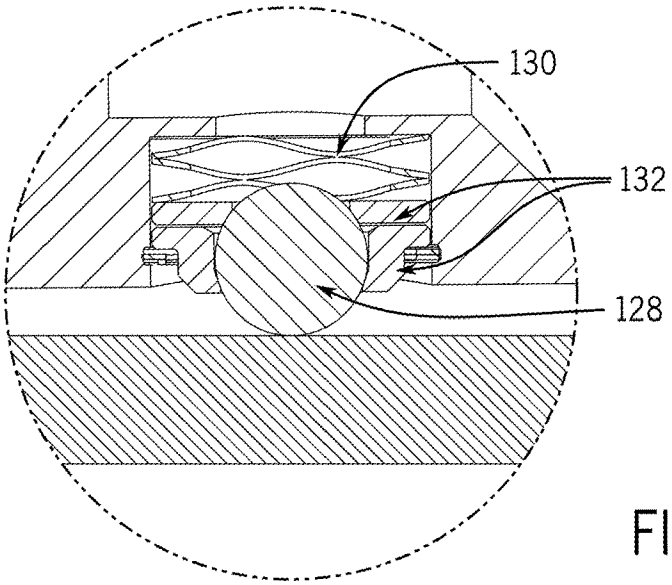
FIG. 22 is an enlarged view of a portion of the deployment device of FIG. 21.

FIG. 22 is an enlarged view of a pivot point illustrated in FIG. 21. The pivot point may consist of a ball 128 and spring 130 mounted with mounting equipment 132 such that the ball and spring are contained. Those skilled in the art will appreciate that the pivot points may also be accomplished by simple rigid knobs. As discussed, pivot point 124 reduces the friction force between load ring 22, energizing ring 66, core 90, deployment device 116 and tubular 88. This reduces the wear on these components and makes them easier to install.

Although the invention has been described with respect to specific embodiments thereof, these embodiments are merely illustrative, and not restrictive of the invention. Rather, the description is intended to describe illustrative embodiments, features and functions in order to provide a person of ordinary skill in the art context to understand the invention without limiting the invention to any particularly described embodiment, feature or function. While specific embodiments of, and examples for, the invention are described herein for illustrative purposes only, various equivalent modifications are possible within the spirit and scope of the invention, as those skilled in the relevant art will recognize and appreciate. As indicated, these modifications may be made to the invention in light of the foregoing description of illustrated embodiments of the invention and are to be included within the spirit and scope of the invention. Thus, while the invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the invention.

Reference throughout this specification to "one embodiment", "an embodiment", or "a specific embodiment" or similar terminology means that a particular feature, structure, or characteristic described in connection with the embodiment is included in at least one embodiment and may not necessarily be present in all embodiments. Thus, respective appearances of the phrases "in one embodiment", "in an embodiment", or "in a specific embodiment" or similar terminology in various places throughout this specification are not necessarily referring to the same embodiment. Furthermore, the particular features, structures, or characteristics of any particular embodiment may be combined in any suitable manner with one or more other embodiments. It is to be understood that other variations and modifications of the embodiments described and illustrated herein are possible in light of the teachings herein and are to be considered as part of the spirit and scope of the invention.

In the description herein, numerous specific details are provided, such as examples of components and/or methods, to provide a thorough understanding of embodiments of the invention. One skilled in the relevant art will recognize, however, that an embodiment may be able to be practiced without one or more of the specific details, or with other apparatus, systems, assemblies, methods, components, materials, parts, and/or the like. In other instances, well-known structures, components, systems, materials, or operations are not specifically shown or described in detail to avoid obscuring aspects of embodiments of the invention. While the invention may be illustrated by using a particular embodiment, this is not and does not limit the invention to any particular embodiment and a person of ordinary skill in the art will recognize that additional embodiments are readily understandable and are a part of this invention.

As used herein, the terms "comprises," "comprising," "includes," "including," "has," "having," or any other variation thereof, are intended to cover a non-exclusive inclusion. For example, a process, product, article, or apparatus that comprises a list of elements is not necessarily limited only those elements but may include other elements not expressly listed or inherent to such process, product, article, or apparatus.

Furthermore, the term "or" as used herein is generally intended to mean "and/or" unless otherwise indicated. For example, a condition A or B is satisfied by any one of the following: A is true (or present) and B is false (or not present), A is false (or not present) and B is true (or present), and both A and B are true (or present). As used herein, a term preceded by "a" or "an" (and "the" when antecedent basis is "a" or "an") includes both singular and plural of such term, unless clearly indicated otherwise (i.e., that the reference "a" or "an" clearly indicates only the singular or only the plural). Also, as used in the description herein, the meaning of "in" includes "in" and "on" unless the context clearly dictates otherwise.

What is claimed is:

1. An apparatus for deployment in a subterranean well at a setting location, the apparatus comprising:

a load ring comprising an outer surface having an outer circumference, an inner surface, a central axis, and a wall having a wall thickness, wherein the wall includes at least one slot extending through the entire wall thickness, and following a circuitous path from a front face of the load ring to a back face of the load ring, and wherein the outer surface is textured with at least a plurality of coaxial and parallel teeth configured to engage and grip the inner surface of a subterranean well;

an energizing ring having an outer surface, an inner surface, and a central axis, wherein the outer surface of the energizing ring is configured to contact the inner surface of the load ring and to enlarge the outer circumference of the load ring in a radial direction thereby causing the outer surface of the load ring to securely grip an inner surface of the subterranean well at a setting location.

2. The apparatus of claim 1, wherein the outer surface of the energizing ring is configured to contact the inner surface of the load ring and to enlarge the outer circumference of the load ring in a radial direction thereby causing the outer surface of the load ring to grip and seal to the inner surface of the subterranean well at the setting location.

3. The apparatus of claim 1, wherein the circuitous path of at least one slot includes a first portion that runs parallel to the central axis at the front face, a second portion that runs parallel to the central axis at the back face, and a third portion that runs perpendicular to the central axis at one or more locations between the front face and the back face.

4. The apparatus of claim 1, wherein the circuitous path of at least one slot includes at least one portion that is oriented at an angle to the central axis.

5. The apparatus of claim 1, wherein the textured outer surface comprises a particulate configured to increase the friction force between the load ring and the subterranean well.

6. The apparatus of claim 1, wherein the outer surface of the load ring includes at least one shoulder extending above the textured outer surface, said shoulder configured to grip the inner surface of the subterranean well.

7. The apparatus of claim 1, wherein the inner surface of the load ring includes a curved, convex surface relative to the central axis of the load ring, and the outer surface of the energizing ring includes a tapered surface relative to the central axis of the energizing ring.

8. The apparatus of claim 1, wherein the inner surface of the load ring includes a tapered surface relative to the central axis of the load ring, and the outer surface of the energizing ring includes a convex surface relative to the central axis of the energizing ring.

9. The apparatus of claim 1, wherein the load ring, the energizing ring, or both the load ring and energizing ring are made of a material that galvanically corrodes in a subterranean well.

10. The apparatus of claim 1, wherein the load ring, the energizing ring, or both the load ring and energizing ring are made of a material that disintegrates or dissolves as a result of an interaction with a fluid in a subterranean well.

11. The apparatus of claim 1, wherein the load ring, the energizing ring, or both the load ring and energizing ring include a composite material.

12. A method of installing an apparatus in a subterranean well comprising:

positioning a load ring and an energizing ring on a deployment device, the load ring comprising an outer surface having an outer circumference, an inner surface, a central axis, and a wall having a wall thickness, wherein the wall includes at least one slot extending through the entire wall thickness and following a circuitous path from a front face of the load ring to a back face of the load ring, and wherein the outer surface is textured with at least a plurality of coaxial and parallel teeth configured to engage and grip the inner surface of a subterranean well;

the energizing ring having an outer surface, an inner surface, and a central axis;

inserting the deployment device and the load ring and the energizing ring into the subterranean well, the load ring and the energizing ring positioned on the deployment device in a first orientation that allows the load ring and the energizing ring and the deployment device to traverse the subterranean well;

delivering the deployment device, the load ring, and the energizing ring to a setting location in the subterranean well; and activating the deployment device to move the outer surface of the energizing ring to contact the inner surface of the load ring to enlarge the outer circumference of the load ring in a radial direction thereby causing the outer surface of the load ring to securely grip an inner surface of the subterranean well at the setting location.

13. The method of claim 12, wherein enlarging the outer circumference of the load ring in a radial direction causes the outer surface of the load ring to seal to the inner surface of the subterranean well at the setting location.

14. The method of claim 12, wherein the circuitous path of at least one slot includes a first portion that runs parallel to the central axis at the front face, a second portion that runs parallel to the central axis at the back face, and a third portion that runs perpendicular to the central axis at one or more locations between the front face and the back face.

15. The method of claim 12, wherein the circuitous path of at least one slot includes at least one portion that is oriented at an angle to the central axis.

16. The method of claim 12, wherein the textured outer surface comprises a particulate configured to increase the friction force between the load ring and the subterranean well.

17. The method of claim 12, wherein the outer surface of the load ring includes at least one shoulder extending above the textured outer surface, said shoulder configured to grip the inner surface of the subterranean well.

18. The method of claim 12, wherein the inner surface of the load ring includes a curved, convex surface relative to the central axis of the load ring, and the outer surface of the energizing ring includes a tapered surface relative to the central axis of the energizing ring.

19. The method of claim 12, wherein the load ring, the energizing ring, or both the load ring and energizing ring are made of a material that galvanically corrodes in a subterranean well.

20. The method of claim 12, wherein the load ring, the energizing ring, or both the load ring and energizing ring are made of a material that disintegrates or dissolves as a result of an interaction with a fluid in a subterranean well.

21. The method of claim 12, wherein the load ring, the energizing ring, or both the load ring and energizing ring include a composite material.

22. The method of claim 12, wherein the deployment device includes a pivot point configured to reduce the friction force between the deployment device and the inner surface of the subterranean well.

23. A subterranean well assembly comprising:

a subterranean well having an inner surface at a setting location;

a load ring comprising an outer surface having an outer circumference, an inner surface, a central axis, and a wall having a wall thickness, wherein the wall includes at least one slot extending through the entire wall thickness and following a circuitous path from a front face of the load ring to a back face of the load ring, and wherein the outer surface is textured with at least a plurality of coaxial and parallel teeth configured to engage and grip the inner surface of the subterranean well;

an energizing ring having an outer surface, an inner surface, and a central axis, wherein the outer surface of the energizing ring is configured to contact the inner surface of the load ring and to enlarge the outer circumference of the load ring in a radial direction thereby causing the outer surface of the load ring to securely grip the inner surface of the subterranean well at the setting location.

24. The subterranean well assembly of claim 23, wherein the outer surface of the energizing ring is configured to contact the inner surface of the load ring and to enlarge the outer circumference of the load ring in a radial direction thereby causing the outer surface of the load ring to seal to the inner surface of the subterranean well at the setting location.

25. The subterranean well assembly of claim 23, wherein the inner surface of the subterranean well at the setting location is defined by casing.

26. The subterranean well assembly of claim 23, wherein the circuitous path of at least one slot includes a portion that runs perpendicular to the central axis at one or more locations between the front face and the back face of the load ring.

27. The subterranean well assembly of claim 23, wherein the textured outer surface comprises a particulate configured to increase the friction force between the load ring and the subterranean well.

28. The subterranean well assembly of claim 23, wherein the outer surface of the load ring includes at least one shoulder extending above the textured outer surface, said shoulder configured to engage and grip the inner surface of the subterranean well.

29. The subterranean well assembly of claim 23, wherein the inner surface of the load ring includes a curved, convex surface relative to the central axis of the load ring, and the outer surface of the energizing ring includes a tapered surface relative to the central axis of the energizing ring.

30. The subterranean well assembly of claim 23, wherein the inner surface of the load ring includes a tapered surface relative to the central axis of the load ring, and the outer surface of the energizing ring includes a convex surface relative to the central axis of the energizing ring.

31. The subterranean well assembly of claim 23, wherein the load ring, the energizing ring, or both the load ring and energizing ring are made of a material that galvanically corrodes in a subterranean well.

32. The subterranean well assembly of claim 23, wherein the load ring, the energizing ring, or both the load ring and energizing ring are made of a material that disintegrates or dissolves as a result of an interaction with a fluid in a subterranean well.

33. The subterranean well assembly of claim 23, wherein the load ring, the energizing ring, or both the load ring and energizing ring include a composite material.

* * * * *